US007571619B2

(12) United States Patent
Park et al.

(10) Patent No.: US 7,571,619 B2
(45) Date of Patent: Aug. 11, 2009

(54) REFRIGERATOR

(75) Inventors: Sang-min Park, Gwangju (KR); Jae-koog An, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 520 days.

(21) Appl. No.: 11/415,267

(22) Filed: May 2, 2006

(65) Prior Publication Data

US 2006/0248912 A1 Nov. 9, 2006

(30) Foreign Application Priority Data

May 3, 2005 (KR) ..... 10-2005-0037069
Sep. 28, 2005 (KR) ..... 10-2005-0090691

(51) Int. Cl.
*F25C 5/02* (2006.01)

(52) U.S. Cl. ..... 62/320; 241/DIG. 17

(58) Field of Classification Search ..... 62/320; 241/DIG. 17

See application file for complete search history.

(56) References Cited

U.S. PATENT DOCUMENTS 6,082,130 A * 7/2000 Pastryk et al. ..... 62/344
6,904,765 B2 * 6/2005 Lee et al. ..... 62/320
7,278,275 B2 * 10/2007 Voglewede et al. ..... 62/320

FOREIGN PATENT DOCUMENTS

CN 1683851 A 10/2005
JP 46-001586 9/1971
JP 58-79407 5/1983
KR 2000-00032977 6/2000
KR 20-339267 1/2004

OTHER PUBLICATIONS

Japanese Office Action issued Mar. 4, 2008 in Japanese Patent Application No. 2006-126125 (2 pages).
The First Office Action issued by the State Intellectual Property Office of People's Republic of China in the corresponding Chinese Application No. 200610079472.6 (2 pages) (English translation consisting of 3 pages).
Details of the First Office Action for Application No. 200610079472.6 (4 pages) (English translation consisting of 7 pages).

* cited by examiner

*Primary Examiner*—William E Tapolcai
(74) *Attorney, Agent, or Firm*—Staas & Halsey LLP

(57) ABSTRACT

A refrigerator having: an ice storage container in a freezer formed with an opening at a side thereof; an ice breaking part for receiving ice cubes stored in the ice storage container and making shaved ice; a rotating blade which is rotatably provided in the opening; a first discharging part for discharging the ice cubes released to the opening and crushed ice broken by the rotating blade; a second discharging part that communicates with the ice breaking part to cause the ice cubes to be released from the opening and transferred by the rotating blade into the ice breaking part; and first and second discharging levers for opening and closing the first discharging part and the second discharging part, respectively. Thus, the invention provides a refrigerator for selectively distributing and supplying ice stored within an ice storage part to a single transferring unit.

20 Claims, 11 Drawing Sheets

REFRIGERATOR

CROSS-REFERENCE TO RELATED APPLICATIONS

This application claims the benefit of Korean Patent Application Nos. 2005-0037069, filed on May 3, 2005 and No. 2005-0090691, filed on Sep. 28, 2005, in the Korean Intellectual Property Office, the disclosures of which are incorporated herein by reference.

BACKGROUND OF THE INVENTION

1. Field of the Invention

The invention relates to a refrigerator, and more particularly to a refrigerator for selectively distributing and supplying ice stored in an ice storage part.

2. Description of the Related Art

Generally, a refrigerator is provided with a freezing chamber for storing frozen foods, such as meat, fish and so forth, under the freezing temperature and a cooling chamber for storing cold foods, such as fruit, vegetables and so forth, over the freezing temperature.

In the freezing chamber, an icemaker for making ice having a predetermined size using cold air, which is circulated within the freezing chamber and an ice storage part for storing ice are provided. The ice stored within the ice storage part is released outside in the shape of ice cubes 101 or crushed ice 102 according to its use. Such a configuration for discharging ice from the ice storage part is disclosed in Korean Patent Application No. 1998-49615 and so forth.

Recently, shaved ice 103 has been increasingly required to make food such as sherbet at home. However, the conventional refrigerator does not have the function for supplying shaved ice 103.

Further, there has been a problem in that a separate ice cutter can not be additionally mounted within the existing or conventional refrigerator, since the conventional refrigerator is formed with a single discharging part to release ice cubes 101 or crushed ice 102 from the ice storage part. Meanwhile, if supplying shaved ice 103 is separately provided in an ice storage part for an ice cutter, the costs increase and the structure is complicated.

SUMMARY OF THE INVENTION

Additional aspects and/or advantages of the invention will be set forth in part in the description which follows and, in part, will be apparent from the description, or may be learned by practice of the invention.

Accordingly, it is an aspect of the invention to provide a refrigerator for selectively distributing and supplying ice stored within an ice storage part to a single transferring unit according to its use.

Further, it is another aspect of the invention to provide a refrigerator having a rotating blade and a fixed blade having an improved shape to enhance the supporting strength when breaking ice cubes 101 and to easily supply ice to an ice breaking part.

The foregoing and/or other aspects of the invention can be achieved by providing a refrigerator having a freezer and a freezer door for opening and closing the freezer, the refrigerator including: an ice storage container which is provided in the freezer and is formed with an opening at a side thereof; an ice breaking part for receiving ice cubes 101 stored in the ice storage container and making shaved ice 103; a rotating blade which is rotatably provided in the opening; a first discharging part for discharging the ice cubes 101 released to the opening and crushed ice 102 broken by the rotating blade; a second discharging part, which is communicated with the ice breaking part to cause the ice cubes 101, which are released from the opening and transferred by the rotating blade into the ice breaking part; and first and second dispensing levers for opening and closing the first discharging part and the second discharging part, respectively, wherein the second discharging lever opens the second discharging part when discharging the shaved ice 103.

According to an aspect of the invention, the refrigerator further includes an ice transferring unit which includes a driving motor provided in the ice storage container, a rotating shaft having a first end connected to the driving motor and a second end extended to the opening, and a spiral blade rotatably connected to the rotating shaft and transferring the ice cubes 101 within the ice storage container into the opening.

According to an aspect of the invention, the rotating blade has a plurality of blades and is plurally disposed to be spaced from each other at a predetermined interval on the second end of the rotating shaft.

According to an aspect of the invention, the refrigerator further includes at least one fixed blade which is disposed at a predetermined angle with respect to the respective rotating blades within the rotating radii of the plurality of rotating blades to break the ice cubes 101 transferred by the rotating blades into crushed ice 102.

According to an aspect of the invention, the fixed blade has the shape of a long rod extended downwardly from the rotating shaft.

According to an aspect of the invention, the refrigerator further includes a lever driving part for driving the discharging levers.

According to an aspect of the invention, the lever driving part rotates the first discharging lever to a position for opening the first discharging part and rotates the second discharging lever to a position for closing the second discharging part when discharging the ice cubes 101 stored in the ice storage container.

According to an aspect of the invention, the lever driving part rotates the first discharging lever and the second discharging lever to positions for closing the first discharging part and the second discharging part when discharging the crushed ice 102.

According to an aspect of the invention, the lever driving part rotates the first discharging lever to a position for closing the first discharging part and rotates the second discharging lever to a position for opening the second discharging part when discharging the shaved ice 103.

According to an aspect of the invention, the ice breaking part includes a fixing tray which is provided with a shaved ice 103 discharging part, a blade which is provided in the shaved ice 103 discharging part, and a rotating tray which is rotatably provided in the fixing tray to transfer the ice cubes 101 induced into the fixing tray to the blade.

According to an aspect of the invention, the refrigerator further includes a dispenser provided in the freezer door and an ice duct, which is provided in the freezer door to guide the ice released from the shaved ice 103 discharging part and the first discharging part to the dispenser.

The foregoing and/or other aspects of the invention can be achieved by providing a refrigerator having a freezer and a freezer door for opening and closing the freezer, the refrigerator including: an ice storage container, which is provided in the freezer and is formed with an opening at a side thereof; an ice breaking part for receiving ice cubes 101 stored in the ice storage container and making shaved ice 103; a rotating blade which is rotatably provided in the opening and has three or more blades disposed at a predetermined angle therebetween; a first discharging part for discharging the ice cubes 101 released to the opening and crushed ice 102 broken by the rotating blade; a second discharging part which is communicated with the ice breaking part to induce the ice cubes 101 which is released from the opening and is transferred by the rotating blade into the ice breaking part; and first and second discharging levers for opening and closing the first discharging part and the second discharging part, respectively.

According to an aspect of the invention, the refrigerator further includes an ice transferring unit which includes a driving motor provided in the ice storage container, a rotating shaft having a first end connected to the driving motor and a second end extended to the opening, and a spiral blade rotatably connected to the rotating shaft and transferring the ice cubes 101 within the ice storage container into the opening.

According to an aspect of the invention, the rotating blade has three blades and the blades are plurally disposed to be spaced from each other at a predetermined interval on the second end of the rotating shaft.

According to an aspect of the invention, the refrigerator further includes at least one fixed blade which is disposed at a predetermined angle with respect to the respective rotating blades within the rotating radii of the plurality of rotating blades to break the ice cubes 101 transferred by the rotating blades into crushed ice 102.

According to an aspect of the invention, the second discharging part is provided below the opening and the first discharging part is provided in a side of the first discharging part so that the ice discharged from the opening is transferred by the rotating blade and is discharged to the ice breaking part, the fixed blade having a first end connected to the rotating shaft and a second end which is bent in the shape of 'L' toward the first discharging part.

According to an aspect of the invention, the refrigerator further includes a lever discharging part for driving the discharging levers.

According to an aspect of the invention, the lever driving part rotates the first discharging lever to a position for opening the first discharging part and rotates the second discharging lever to a position for closing the second discharging part when discharging the ice cubes 101 stored in the ice storage container.

According to an aspect of the invention, the lever driving part rotates the first discharging lever and the second discharging lever to positions for closing the first discharging part and the second discharging part when discharging the crushed ice 102.

According to an aspect of the invention, the lever driving part rotates the first discharging lever to a position for closing the first discharging part and rotates the second discharging lever to a position for opening the second discharging part when discharging the shaved ice 103.

The foregoing and/or other aspects of the invention can be achieved by providing a refrigerator having a freezer, a freezer door for opening and closing the freezer and a dispenser which is provided in the freezer door. The refrigerator includes: an ice storage container, which is provided in the freezer and is formed with an opening at a side thereof; an ice breaking part for receiving ice cubes 101 stored in the ice storage and making shaved ice 103; an ice cube supplying part having an ice cube discharging part communicated with the opening to supply the ice cubes 101 to the dispenser; a crushed ice 102 supplying part having a crushed ice 102 discharging part for discharging crushed ice 102 made by breaking the ice cubes 101 released into the opening by the rotating blade which is in the opening to supply the crushed ice 102 to the dispenser; and an ice supplying part, which is communicated with the opening to release the ice cubes 101 to the ice breaking part.

BRIEF DESCRIPTION OF THE DRAWINGS

The above and/or other aspects and advantages of the prevent invention will become apparent and more readily appreciated from the following description of the exemplary embodiments, taken in conjunction with the accompany drawings, in which.

DETAILED DESCRIPTION OF THE PREFERRED EMBODIMENTS

Figure 1:
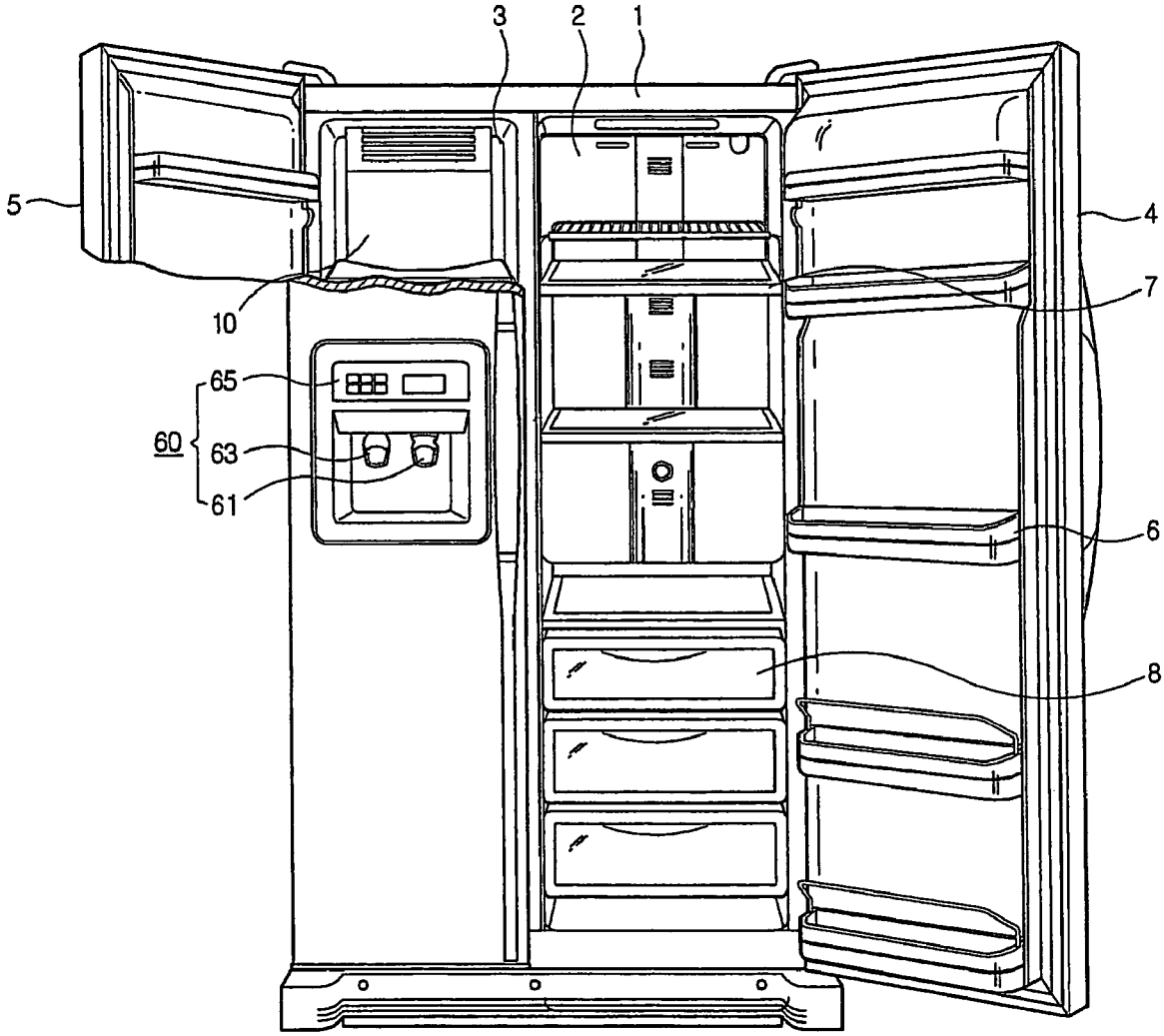
FIG. 1 is a perspective view showing an outer appearance of a refrigerator according to the invention.

Reference will now be made in detail to the embodiments of the invention, examples of which are illustrated in the accompanying drawings, wherein like reference numerals refer to like elements throughout. The embodiments are described below so as to explain the invention by referring to the figures.

Preferred embodiments of the invention are explained based on a side by side type refrigerator. However, the invention is not limited to this type of or configuration of a refrigerator.

EXAMPLE 1 (FIGS. 3 TO 6)

A refrigerator according to the invention includes a freezing chamber 3, an ice storage container 11, which is provided within the freezing chamber 3 and is formed with an opening at a side thereof, an ice breaking part 80, which receives ice cubes 101 from the ice storage container 11 and makes shaved ice 103, a rotating blade 41, a front cover 30, which is formed with a first discharging part 31 and a second discharging part 33, a first discharging lever 51 for opening and closing the first discharging part 31, and a second discharging lever 53 for opening and closing the second discharging part 33.

The refrigerator according to the invention may further include at least one among an ice transferring unit 20, a lever driving part 55 and a fixed blade 45.

Referring to FIG. 1, a refrigerator according to a first embodiment of the invention is partitioned into a cooling chamber 2 and the freezing chamber 3 by a middle partition wall. The cooling chamber 2 is provided with a cooling chamber door 4 for opening and closing a front opening of the cooling chamber 2 and the freezing chamber 3 is provided with a freezing chamber door 5 for opening and closing a front opening of the freezing chamber 3. Each of the doors 4 and 5 is provided with a door guide 6 for receiving bottles in the upper and lower parts thereof. Further, the cooling chamber 2 is provided with a plurality of shelves 7 for partitioning the inside of the cooling chamber 2 in an upper part thereof and is provided with a plurality of drawers 8 in a lower part thereof.

The freezing chamber 3 is provided with an ice making chamber 70 (refer to FIG. 2) having an icemaker in the upper part thereof. In a front side of the freezing chamber door 5, a dispenser 60 for receiving ice made from the ice making chamber 70 and drinking water supplied from the outside is provided. The dispenser 60 is provided with a water lever 61 for supplying drink water and an ice lever 63 for supplying ice. Further, the dispenser 60 is provided with a menu 65 having a plurality of selection keys for selecting one of ice cubes 101, crushed ice 102 and shaved ice 103 in an upper part thereof.

Figure 2:
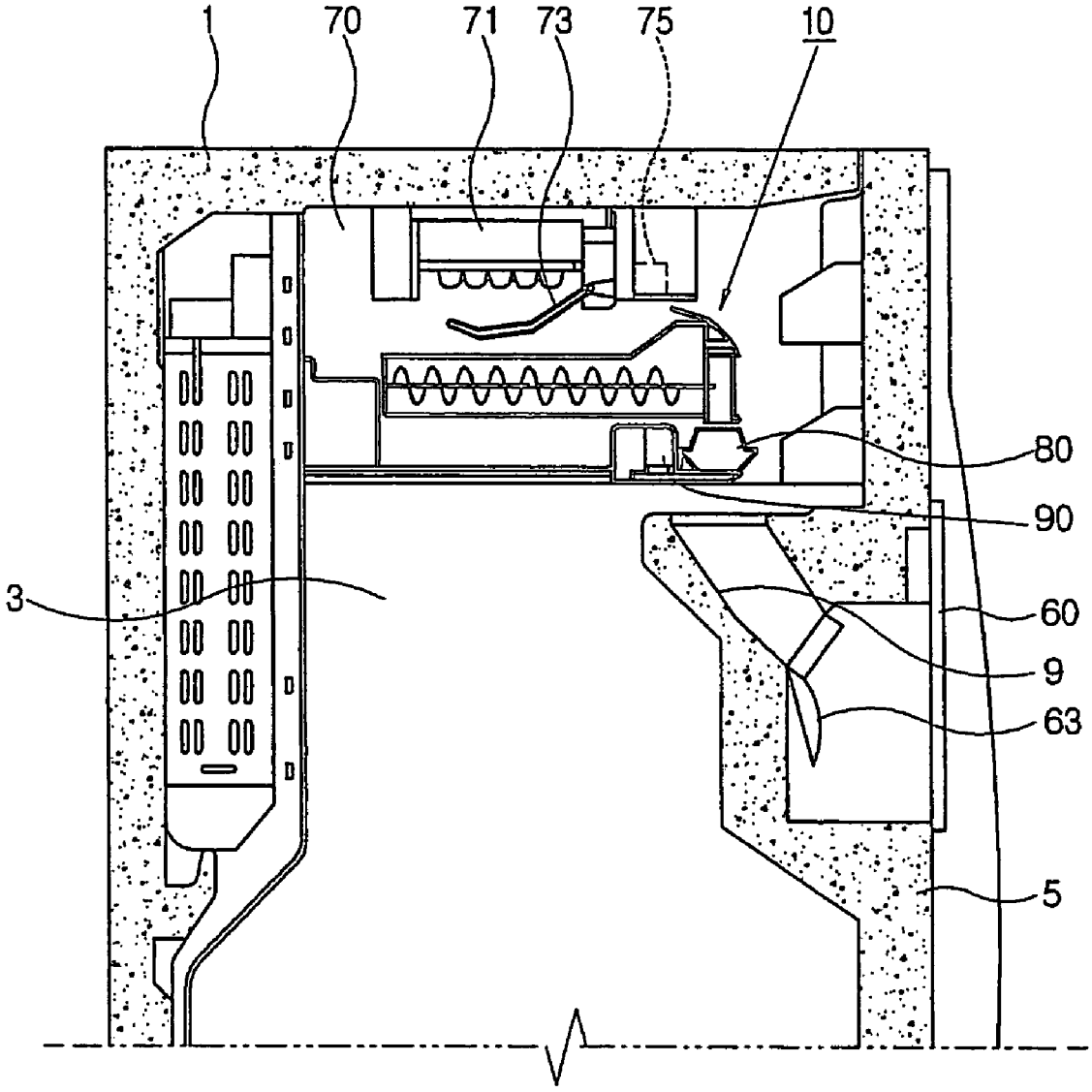
FIG. 2 is an enlarged sectional view showing a freezing chamber of the refrigerator in FIG. 1.

Referring to FIG. 2, the ice making chamber 70 is equipped with an ice making tray 71 for storing water supplied outside of the freezer. The ice making tray 71 is provided with an ice storage part 10 for storing ice separated from the ice making tray 71 in a lower part thereof. Further, an ice separating motor 75 for separating ice by rotating the ice making tray 71 at a predetermined angle and a full sensing lever 73 for sensing whether the ice storage part 10 is full of ice or not are provided adjacent to the ice making tray 71.

Figure 3:
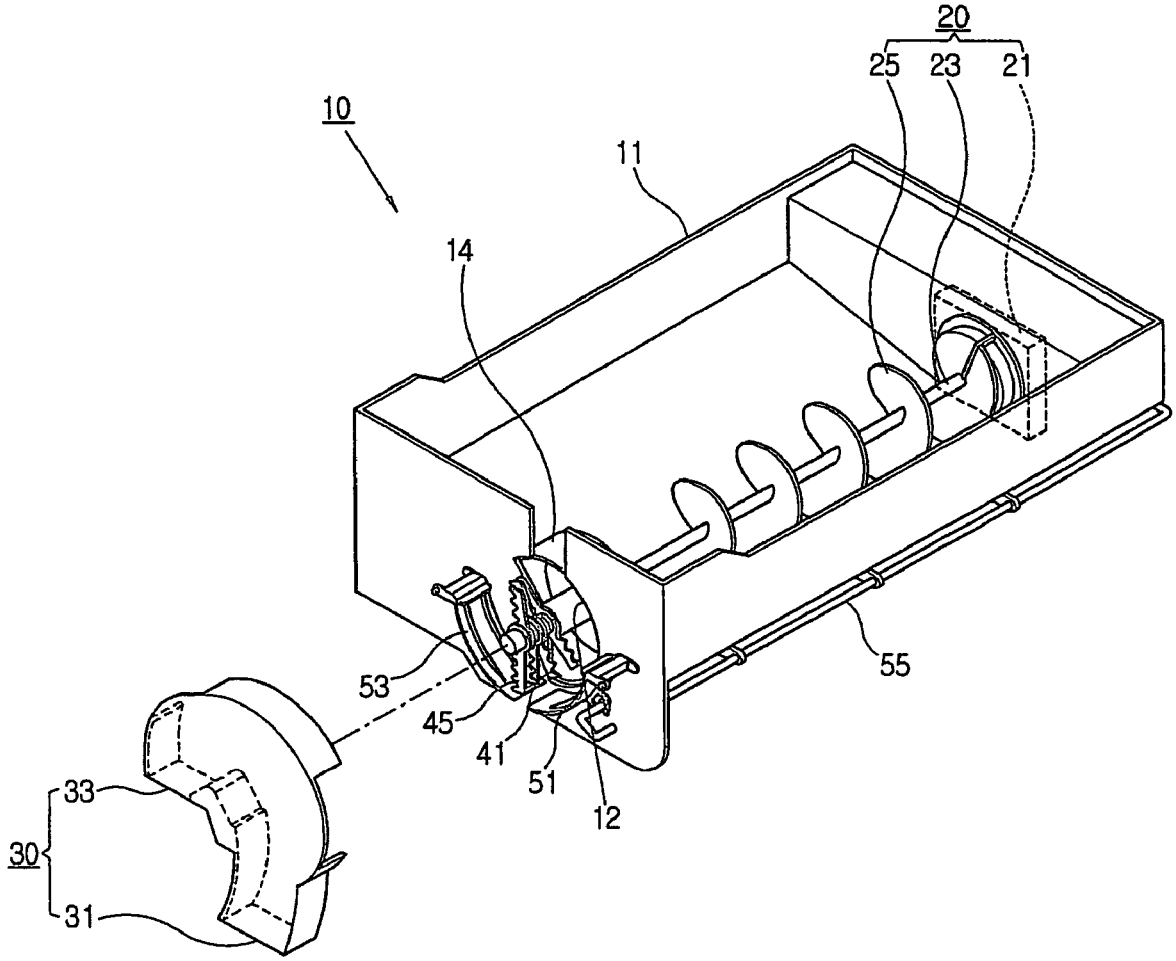
FIG. 3 is a perspective view showing an ice storage part according to a first embodiment of the invention.

Referring to FIG. 3, the ice storage part 10 according to the invention includes the ice storage container 11, which is formed with the opening 12, the ice transferring unit 20 for transferring ice within the ice storage container 11 to the opening 12, the front cover 30, which is formed with the discharging parts 31 and 33, the discharging levers 51 and 53 for opening and closing the discharging parts 31 and 33, and the fixed blade 45 and the rotating blade 41, which breaks the stored ice.

The ice storage container 11, which stores ice in the freezing chamber 3 has the opening 12 for discharging the stored ice to the outside. The ice storage container 11 is formed with a storing space for storing ice separated from the ice making tray 71.

The opening 12 is formed on one side of the ice storage container 11 to release the stored ice to the outside. The opening 12 may have various shapes and sizes. For example, it may have a circular shape or a semi circular shape as shown in FIG. 3.

A guide box 14 is provided to prevent the opening 12 from being blocked by ice transferred to the opening 12. The guide box 14 may have various sizes and shapes. Further, it may correspond to the shape and size of the opening 12.

The ice transferring unit 20 includes a driving motor 21, which is provided within the ice storage container 11, a rotating shaft 23, which extends to the opening 12 and a spiral blade 25 combined to the rotating shaft 23. Here, the spiral blade 25 is rotated to push out ice stored in the ice storage part 10 to the opening 12.

The driving motor 21, which is provided on one side of the ice storage container 11 and transfers a driving force into the rotating shaft 23.

While one end of the rotating shaft 23 is connected to the driving motor 21, the other end of the rotating shaft 23 is extended to the opening 12. The rotating shaft 23 receives the driving force from the driving motor 21 and rotates the spiral blade 25, thereby transferring the driving force into the rotating blade 41 connected to the other end of the rotating shaft 23.

The spiral blade 25 is rotatably connected to the rotating shaft 23, thereby pushing out ice within the ice storage container 11 toward the opening 12. The spiral blade 25 may have a variety of shapes. For example, as shown in FIG. 3, it may be provided as a spiral surface integrally formed in the radial direction of the rotating shaft 23. Alternatively, the rotating shaft 23 may be formed into a spiral shape.

The front cover 30 is provided on the opening 12 and has the plurality of discharging parts 31 and 33 for guiding ice released through the opening 12 to a plurality of positions. The front cover 30 may have various shapes as necessary. For example, as shown in FIG. 3, it may be formed to surround the opening 12 except for the discharging parts 31 and 33 so that flakes of ice broken by the rotating blade 41 and the fixed blade 45 do not fly in all directions. Further, the front cover 20 may further have a partition plate 37 for partitioning the discharging parts 31 and 33. Here, the front cover 30 may have three or more discharging parts according to the type of ice used. Further, the positions of the respective discharging parts may be changed.

The discharging levers 51 and 53 open and close the plurality of discharging parts 31 and 33. One end of each of the discharging levers 51 and 53, for example, may be rotatably connected to the ice storage container 11 to open and close each of the discharging parts 31 and 33.

The number of discharging levers 51 and 53 may correspond to the number of the discharging parts 31 and 33. For example, if two discharging parts 31 and 33 are provided, two discharging levers 51 and 53 may be provided. If ice cubes 101 and crushed ice 102 are released through the discharging parts 31 and 33, respectively, three discharging levers 51 and 53 may be provided. Alternatively, four discharging levers may be provided according to its use. Here, the discharging levers 51 and 53 may simultaneously open and close the respective discharging parts 31 and 33 or selectively open and close any one of them.

A lever driving part 55 is provided to drive the respective discharging levers 51 and 53. The lever driving part 55 may be provided in a various manner according to a method for opening and closing the discharging levers 51 and 53. For example, when the discharging levers 51 and 53 are provided as shown in FIG. 3, the lever driving part 55 may have a solenoid valve.

The rotating blade 41 is rotatably connected to the other end of the rotating shaft 23 to transfer ice cubes 101 through the opening 12 to the fixed blade 45. The rotating blade 41 may have a plurality of sharp projections for easily breaking ice cubes 101 at a front side of each blade 41 with respect to its rotating direction.

The number of the rotating blades 41 may be adjusted as necessary. That is, only one rotating blade 41 or a plurality of rotating blades 41 may be provided. In the case of the plurality of rotating blades 41, the respective rotating blades 31 may be disposed in parallel. Further, the rotating blades 41 may be provided to form a predetermined angle therebetween. For example, as shown in FIG. 3, two blades may be provided.

The fixed blade 45 crosses the rotating blade 41 at a predetermined angle so that it may not affect or interfere with the rotation of the rotating blade 41 within the rotation radius of the rotating blade 41. The fixed blade 45 breaks ice cubes 101 which is received and transferred by the rotating blade 41 into crushed ice 102 using the rotating force of the rotating blade 41.

The fixed blade 45 may have a plurality of sharp projections at its surface facing ice cubes 101. At least one fixed blade 45 may be provided as necessary.

Figure 6:
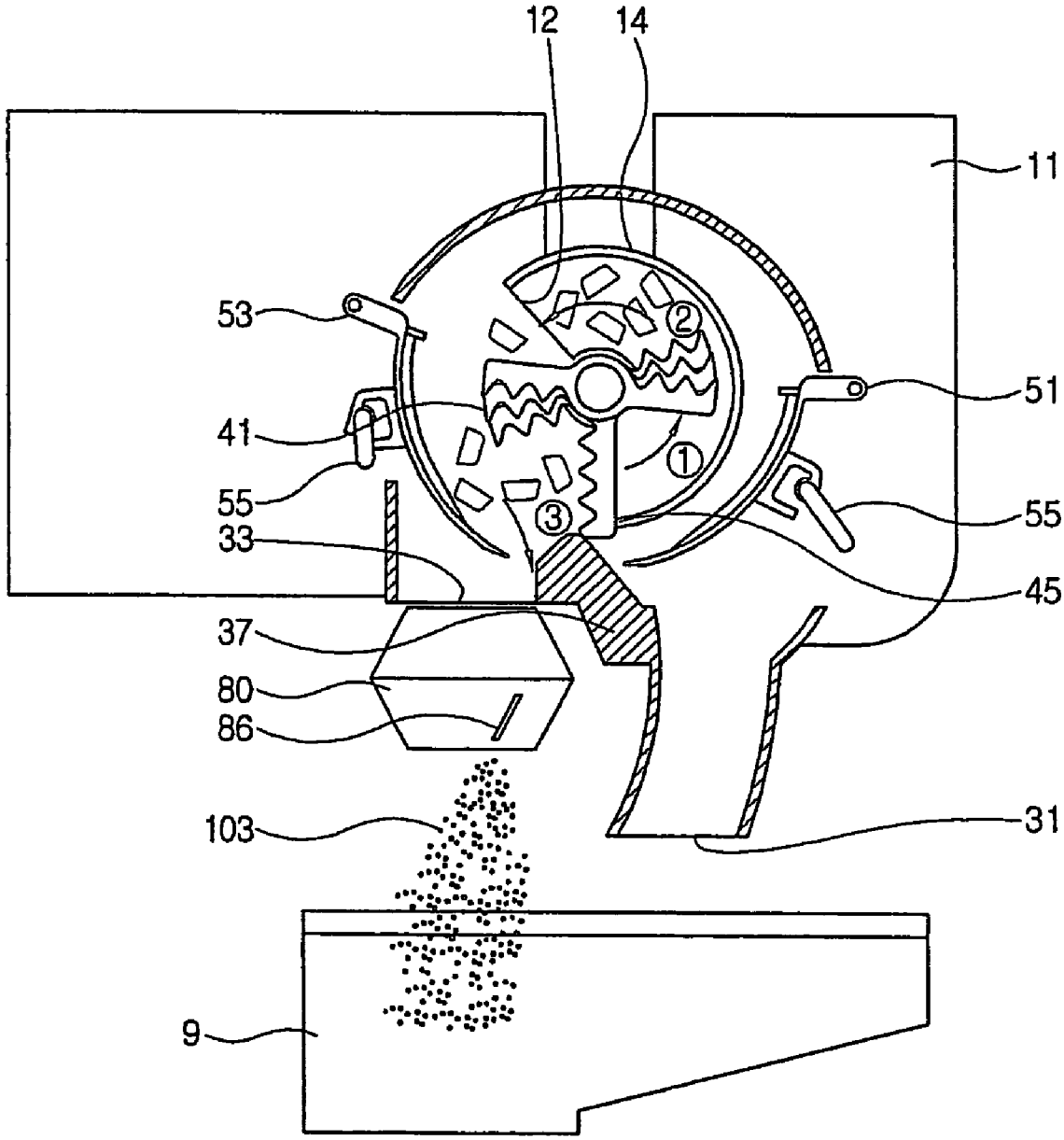
FIG. 6 is a front view of the ice storage part in FIG. 3, which shows the position of a rotating blade and a discharging lever when discharging shaved ice 103.

The fixed blade 45 may be in a variety of shapes as long as it does not prevent ice cube transferred by the rotating blade 41 from dropping into the second discharging part 33. For example, the fixed blade 45, as shown in FIG. 3, may have the shape of a rod that extends vertically downward from the rotating shaft 23. With such a shape, ice is transferred by the rotating blade 41, as shown in FIG. 6, and caused to contact the ice breaking part 80 without subjecting the ice to the fixed blade 45.

The ice breaking part 80 communicates with the second discharging part 33 to receive ice cubes 101 released from the ice storage container 11 and to make crushed ice 102.

Figure 11:
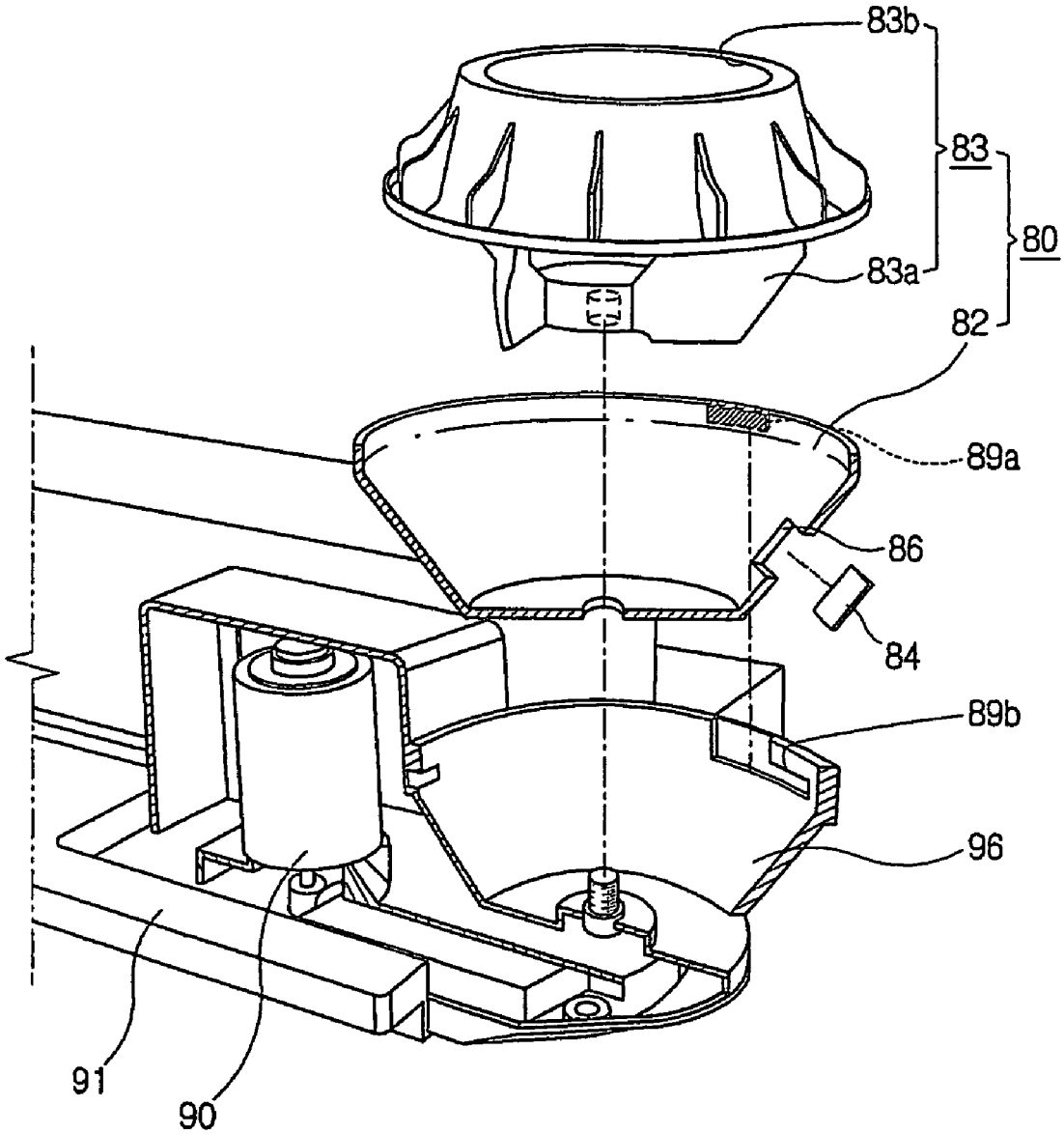
FIG. 11 is an exploded perspective view of an ice breaking part in FIG. 2.

For example, the ice breaking part 80, as shown in FIG. 11, may include a fixing tray 82, which is formed with a shaved ice 103 discharging part 86, a blade 84, which is provided in the shaved ice 103 discharging part 86 and a rotating tray 83, which is rotatably provided in the fixing tray 82 to transfer ice cubes 101 within the fixing tray 82 to the blade 84. Meanwhile, a driving part 90 for driving the ice breaking part 80 may be further provided.

With the configuration, if ice cubes 101 are received in the fixing tray 82 through an ice inlet 83*b* that communicates with the second discharging part 33, the blade 83*a* of the fixing tray 83 which is rotated by the driving part 90 transfers the ice cubes 101 to the blade 84. The shaved ice 103, which is cut by the blade 84, is released into the shaved ice 103 discharging part 86.

The ice breaking part 80 is detachably mounted to a supporting member 91, which is equipped with the ice storage container 11. The supporting member 91 is provided with a receiving part 96 for accommodating the ice breaking part 80. The fixing tray 82 is provided with a hooking projection 89*a* at its outer circumference and the receiving part 96 is provided with a receiving recess 89*b* for receiving the hooking projection 89*a*.

The process for supplying ice of the refrigerator according to the first embodiment of the invention will be explained with reference to FIGS. 4 to 6 hereinafter.

Figure 4:
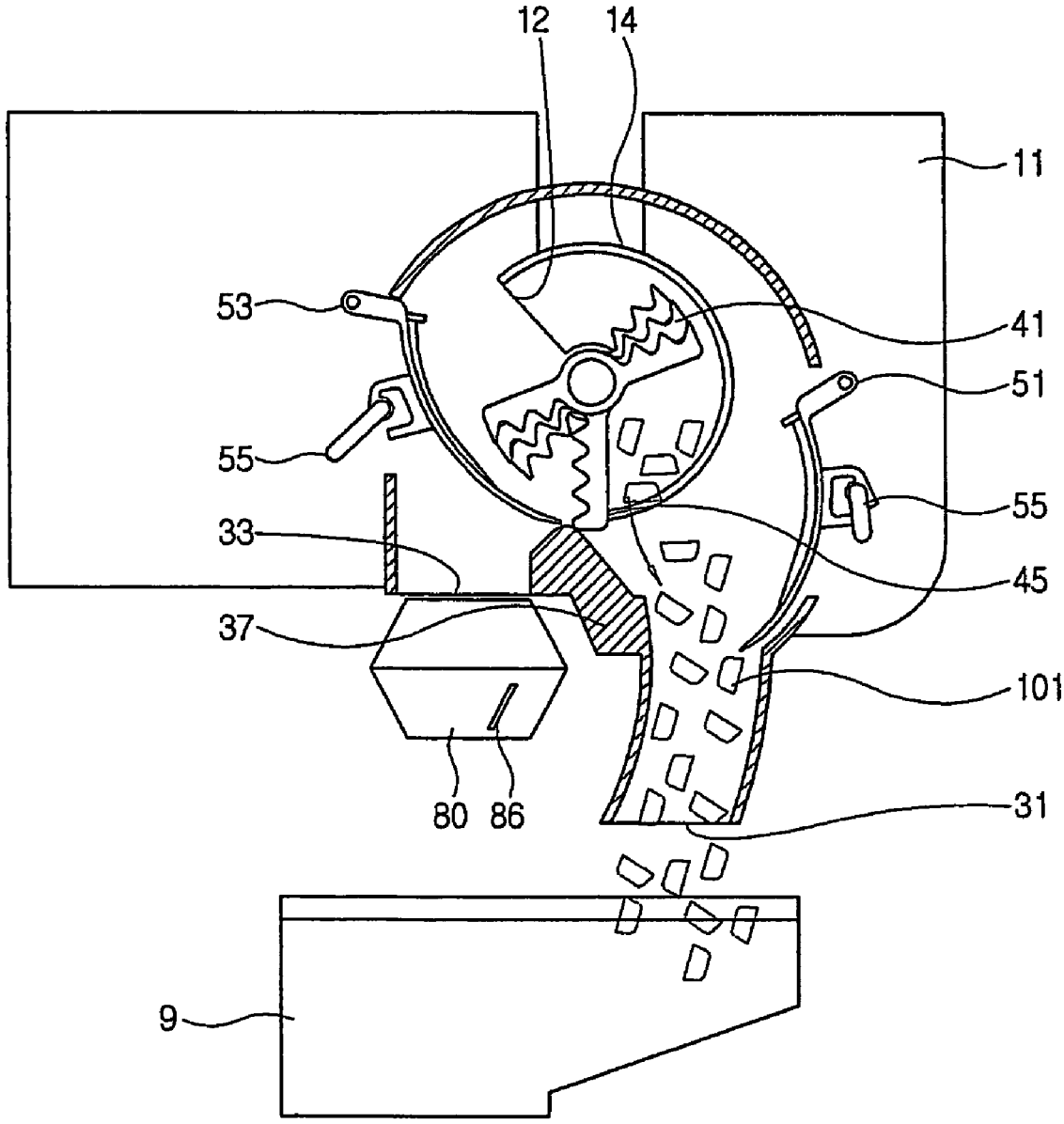
FIG. 4 is a front view of the ice storage part in FIG. 3, which shows the position of a rotating blade and a discharging lever when discharging ice cubes 101.

Discharging Ice Cubes (FIG. 4)

First, the first discharging part 31 is provided in the lower part of the opening 12 to directly cause ice to be released from the opening 12 into the ice duct 9. The second discharging part 33 communicates with the ice breaking part 80 that is provided in the left side of the fixed blade 45.

FIG. 3 illustrates when a user selects an ice cube type from the menu 65 and then pushes or depresses the ice lever 63, the driving motor 21 operates to rotate the rotating shaft 23. As shown in FIG. 3, the spiral blade 25 is rotated along with the rotating shaft 23 to push out the ice cubes 101 within the ice storage container 11 to the opening 12.

When discharging the ice cubes 101, the position of the respective discharging levers 51 and 53 is as follows. That is, the first discharging lever 51 is in the rotated state so that the first discharging part 31 is opened and the second discharging lever 53 is in the state for keeping the second discharging part 33 closed.

Thus, the ice cubes 101 transferred to the opening 12 by the ice transferring unit 20 is passed through the space between the rotating blade 41 and the fixed blade 45 and then is released to the first discharging part 31. The ice that is formed travels through the first discharging part 31 to the ice duct 9 as shown by the arrow in FIG. 4.

Figure 5:
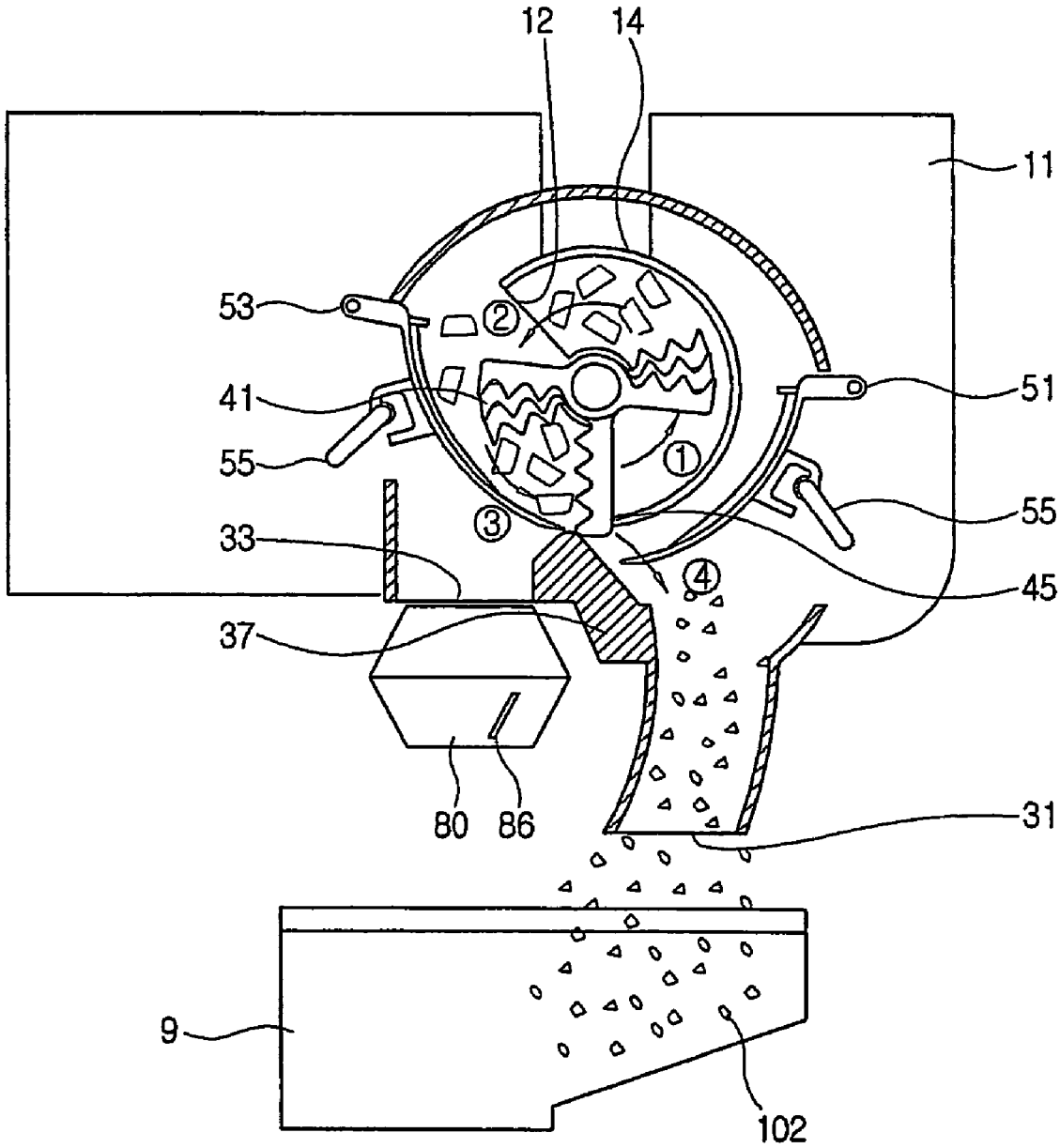
FIG. 5 is a front view of the ice storage part in FIG. 3, which shows the position of the rotating blade and the discharging lever when discharging crushed ice 102.

Discharging Crushed Ice (FIG. 5)

The process for discharging crushed ice 102 from the operation for selecting a crushed ice 102 through the menu 65 to the operation for discharging the crushed ice 102 within the ice storage container 11 into the opening 12 is same as the above mentioned process.

When discharging the crushed ice 102, the first discharging lever 51 and the second discharging lever 53 is in the state for closing the first discharging part 31 and the second discharging part 33, respectively. Thus, the ice cubes 101 pushed out from the opening 12 by the spiral blade 25 are received in the rotating blade 41 and then are rotated (See ① and ② in FIG. 5).

Meanwhile, since the second discharging lever 53 closes the second discharging part 33, ice that is transferred by the ice transferring unit 20 is then transferred to the fixed blade 45 and is broken in order to crush the ice (See ③ in FIG. 5). Then, the crushed ice 102 is released between the fixed blades 45 into the first discharging part 31. (See ④ in FIG. 5)

Discharging Shaved Ice (FIG. 6)

When discharging shaved ice 103, the first discharging lever 51 is positioned in order to close the first discharging part 31. Thus, the ice cubes 101 pushed out from the opening 12 by the ice transferring unit 20 is received and transferred by the rotating blade 41. (See ① in FIG. 6)

Meanwhile, the second discharging lever 53 is rotated in order to open the second discharging part 33. Thus, if ice is transferred by the rotating blade 41 and passes through the highest point, the ice is released into the second discharging part 33 by its own weight. (See ② and ③ in FIG. 6). Here, since the fixed blade 45 has a vertically long rod, the ice cubes 101 without contacting the fixed blade 45 are transferred into the second discharging part 33.

Then, after the ice cubes 101 is broken into the shaved ice 103 in the shaved ice 103 device 40, the shaved ice 103 is released into the ice duct 9 and then is supplied to a user.

Thus, according to the refrigerator of the first embodiment of the invention, since ice may be formed into a plurality of types of ice such as shaved, crushed, or cubed ice and released into a plurality of positions according to its use using one ice storage container 11 and one ice transferring unit 20. Therefore, it is not necessary to provide different storage containers for multiple uses, thus, reducing costs and enhancing the use of the limited space in the freezer.

EXAMPLE 2 (FIGS. 7 TO 10)

A second embodiment of the invention relates to a refrigerator for enhancing the breaking force of the rotating blade 42 and the fixed blade 46 by improving the shapes of the blades and the ease of supplying the ice cubes 101 to the ice breaking part 80.

The description of the duplicate elements as those found in the first embodiment will be omitted to avoid duplication. Thus, elements that are different from those of the first embodiment will be explained hereinafter.

The refrigerator according to the second embodiment of the invention includes the ice storage container 11, the ice breaking part 80, the rotating blade 42 which is rotatably provided in the opening 12 and has three or more blades disposed at a predetermined angle, the front cover 30 having the first discharging part 31 and the second discharging part 33 and the discharging levers 51 and 53 for opening and closing the plurality of discharging parts 31 and 33.

Figure 7:
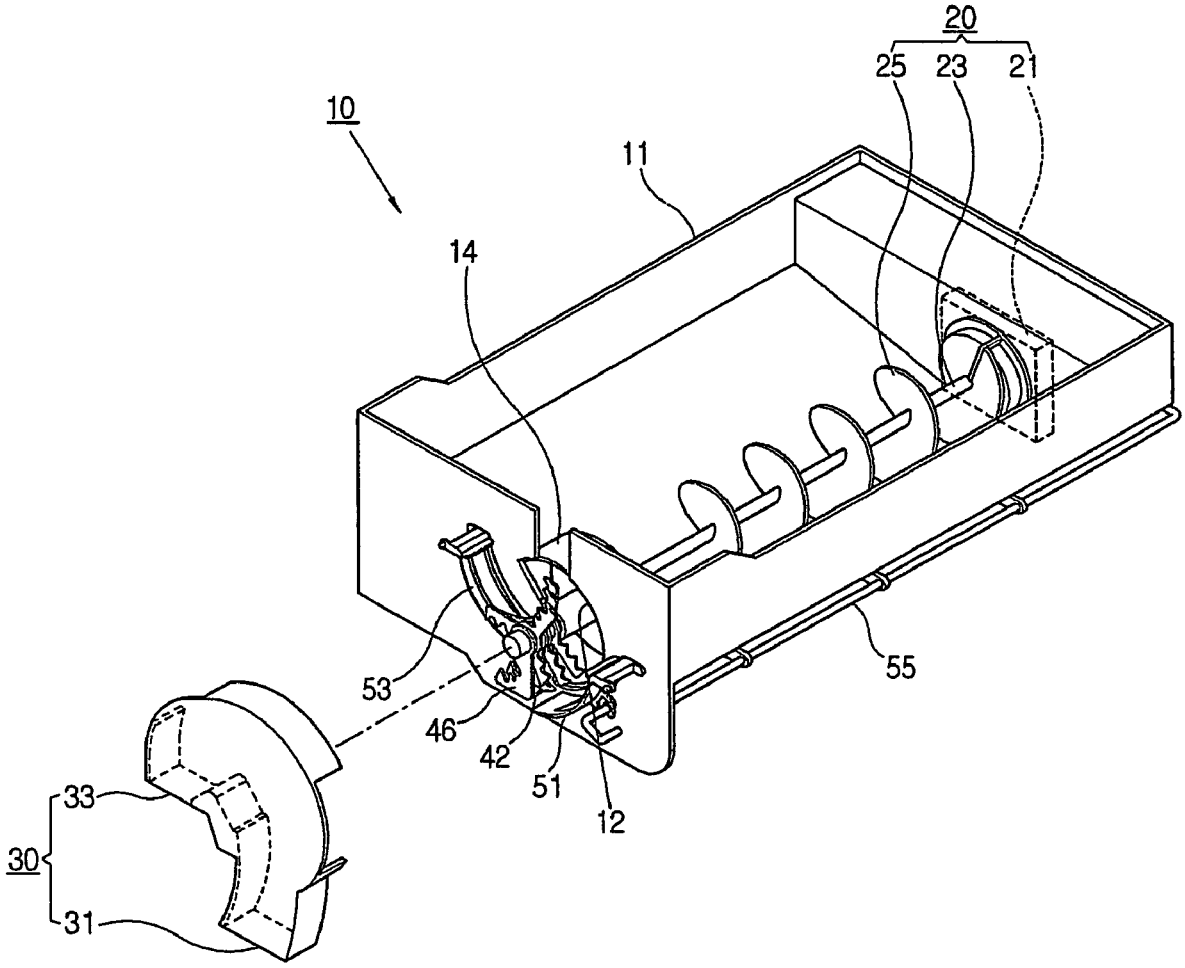
FIG. 7 is a perspective view showing the ice storage part according to a second embodiment of the invention.

The fixed blade 46 according to the second embodiment of the invention, as shown in FIG. 7, has the shape of an 'L', which is bent toward the second discharging part 33. Thus, since upon discharging the crushed ice 102, the rotating force of the rotating blade 42 may be efficiently supplied, the breaking force may be enhanced and the deleterious effects on the adjacent parts due to weakening of the rotating force may be minimized.

The rotating blade 42 according to the second embodiment of the invention may have three or more blades. The number of the blades may be adjusted as necessary. For example, three blades 42*a*, 42*b* and 42*c* may be provided. Further, angles between the blades 42*a*, 42*b* and 42*c* are not specifically limited. However, in an embodiment of the invention, the angles establish the blades to be evenly spaced.

For example, in the case that the rotating blade 42 has three blades 42*a*, 42*b* and 42*c* disposed at equal angles, when ice which is rotatably transferred by the blades 42*a*, 42*b* and 42*c* falls free, a leading blade is positioned to form a predetermined angle with respect to the upper part of the fixed blade 46.

Thus, even though the fixed blade 46 does not have the shape of a vertically long rod as described above, it is possible to supply the ice to the ice breaking part 80 without prevention of the fixed blade 46.

Here, the fixed blade 46 may have various shapes. Further, the number of the blades 42 and the angles between them may be changed.

The ice supplying process of the refrigerator according to the second embodiment of the invention will be explained with reference to FIGS. 8 to 10.

Figure 8:
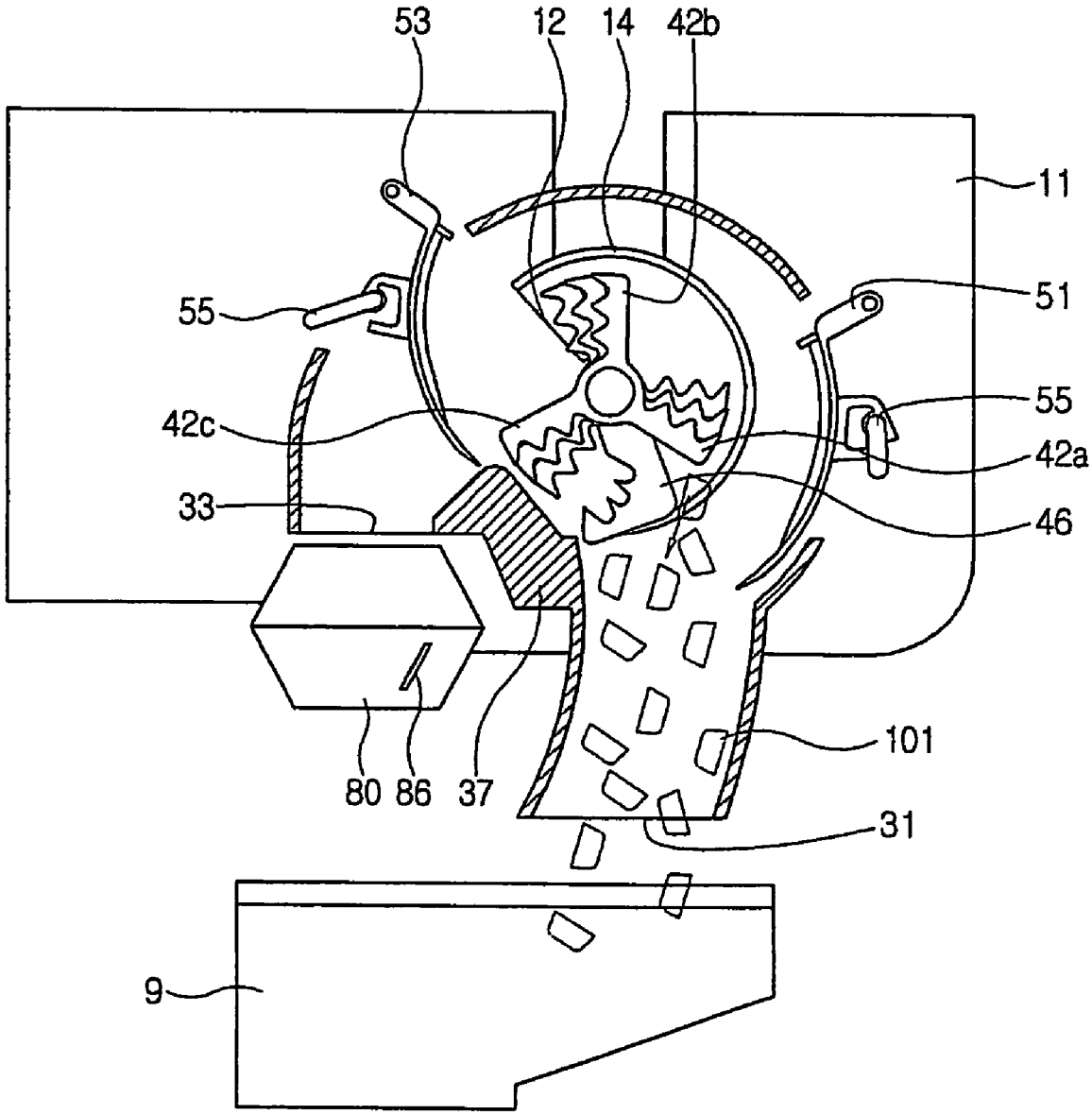
FIG. 8 is a front view of the ice storage part in FIG. 7, which shows the position of a rotating blade and a discharging lever when discharging ice cubes 101.

Discharging Ice Cubes (FIG. 8)

When discharging the ice cubes 101, the first discharging lever 51 is in the rotated state so that the first discharging part 31 is opened and the second discharging lever 53 is in the state for keeping the second discharging part 33 closed.

Thus, the ice cubes 101 transferred to the opening 12 by the ice transferring unit 20 is passed through the space between the rotating blade 41 and the fixed blade 45 and then is released to the first discharging part 31. (See an arrow in FIG. 8)

Figure 9:
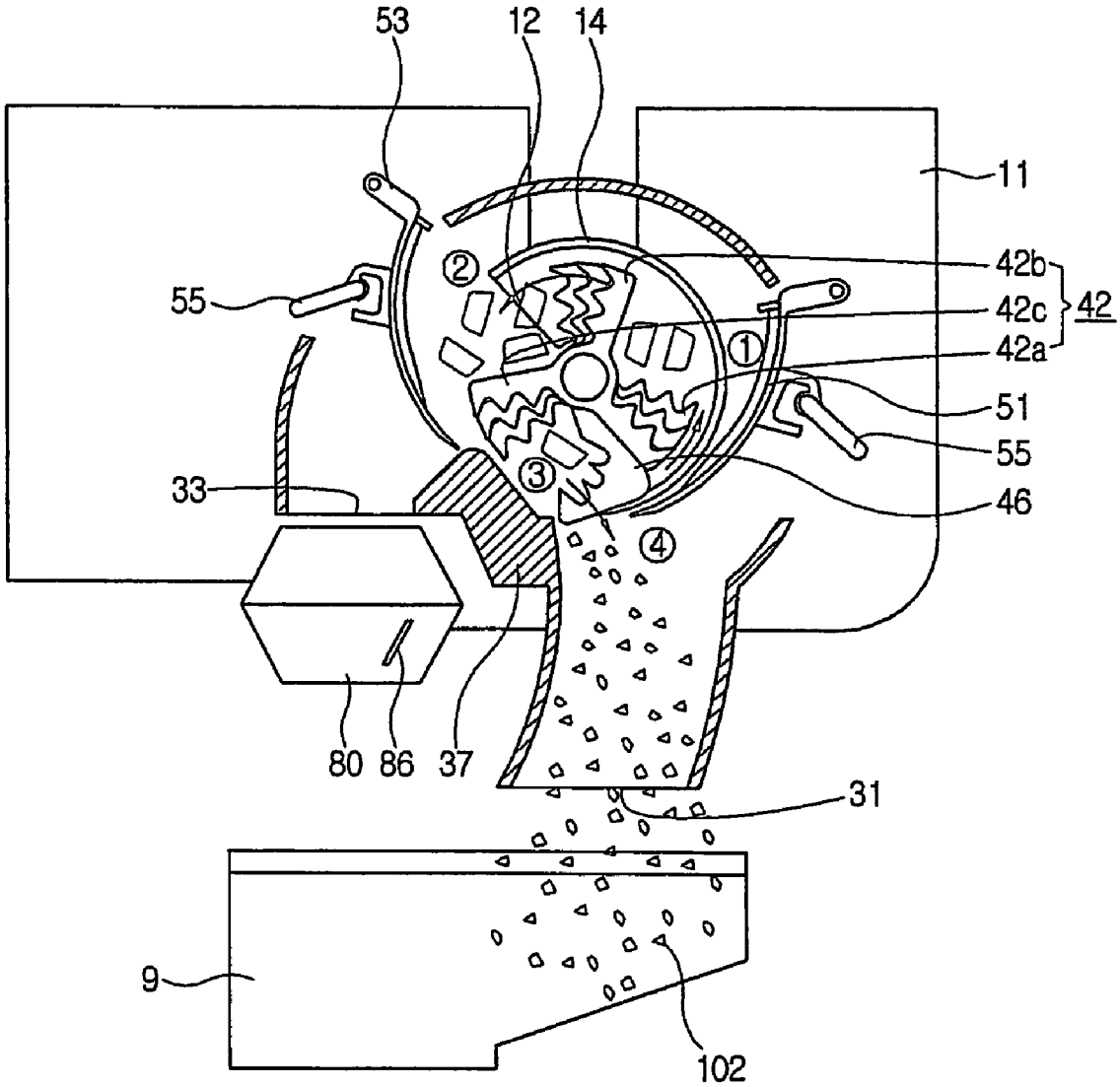
FIG. 9 is a front view of the ice storage part in FIG. 7, which shows the position of the rotating blade and the discharging lever when discharging crushed ice 102.

Discharging Crushed Ice (FIG. 9)

When discharging crushed ice 102, the first discharging lever 51 and the second discharging lever 53 are in the state for keeping the first discharging part 31 and the second discharging part 33 closed, respectively.

Thus, the ice cubes 101 are pushed out from the opening 12 by the ice transferring unit 20 and are received in the rotating blade 42 (See ① in FIG. 9). Then, the received ice cubes 101 are transferred by the movement of the rotation of the rotating blade 42 (See ② in FIG. 9) and then are broken into the crushed ice 102 between the rotating blade 42 and the fixed blade 46 (See ③ in FIG. 9). Then, the crushed ice 102 is released through the first discharging part 31 into the ice duct 9. (See ④ in FIG. 9)

Figure 10:
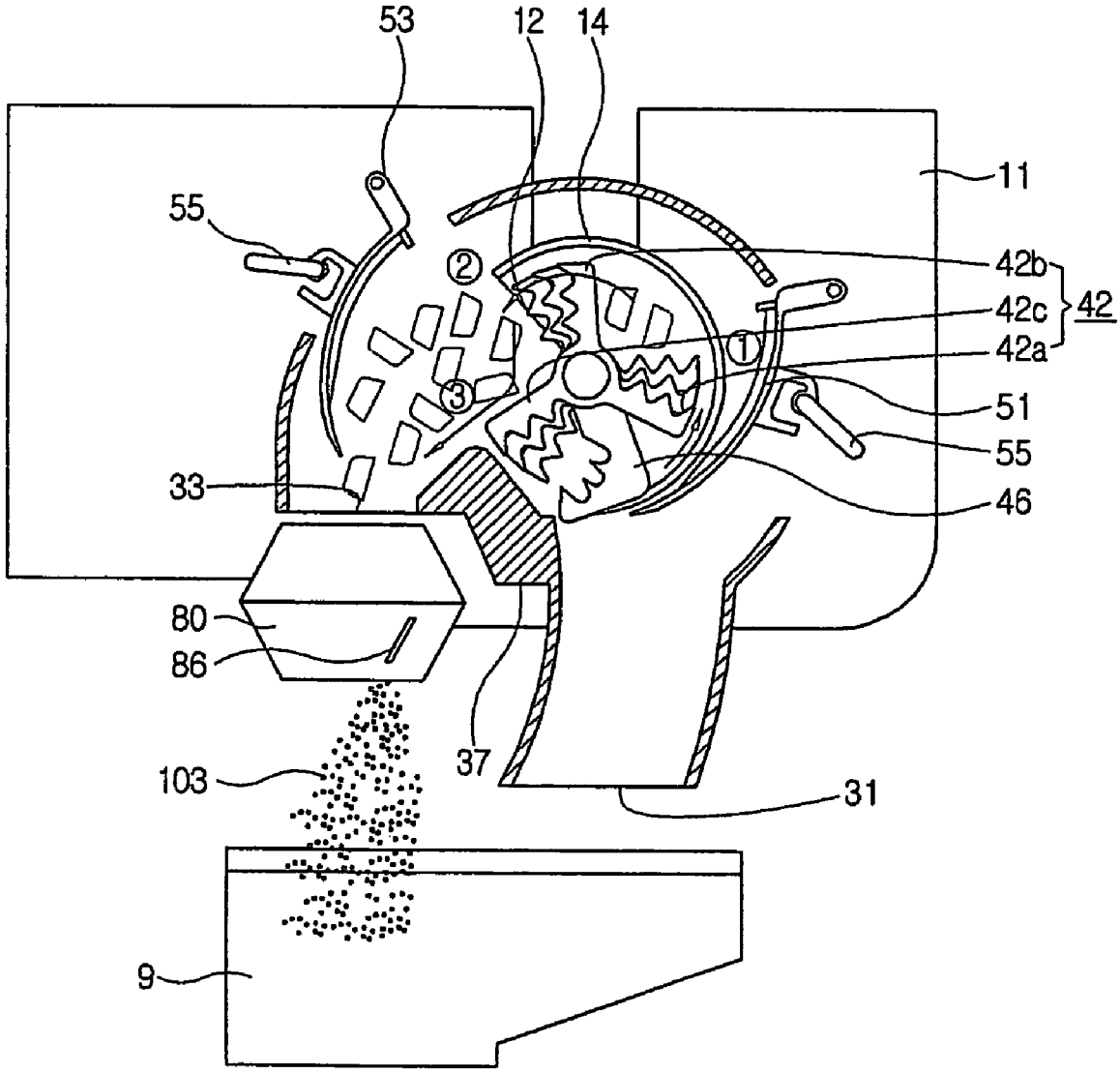
FIG. 10 is a front view of the ice storage part in FIG. 7, which shows the position of a rotating blade and a discharging lever when discharging shaved ice 103.

Discharging Shaved Ice (FIG. 10)

When discharging shaved ice 103, the first discharging lever 51 is pulled to close off the first discharging part 31, and the second discharging lever 53 is rotated to open the second discharging part 33.

The ice cubes 101 pushed out of the opening 12 by the ice transferring unit 20 is received in the rotating blade 42 and then is transferred according to the rotation of the rotating blade 42 (See ① in FIG. 10).

If the blade 42*b* receiving the ice cubes 101 is rotated to be positioned at the highest point, the ice cubes 101 fall freely by its own weight (See ② in FIG. 10). At this time, the ice cubes 101 are guided by the back of the blade 42*c*, which is positioned in the upper part of the fixed blade 46 and then released into the second discharging part 33 (See ③ in FIG. 10).

In the same manner, if the next blade 42*a* rotates and then arrives to the present position, the blade 42*b*, which is positioned at the highest point of the blade 42, rotates and then is positioned over the fixed blade 46.

Thus, according to the refrigerator of the second embodiment of the invention, the rotating blade 42 has three or more blades and the ice cubes 101 fall due to their own weight is guided by the leading blade to be released. Thereby, the ice cubes 101 are easily discharged into the ice breaking part 80 irrespective of the shape of the fixed blade 46.

Further, the space between the blades of the rotating blade 42 has a smaller size when the blades number three compared to when there are only two blades. Since the change in amount of ice cubes 101 transferred by the rotating blade 42 is small, this amount may be adjusted constantly to supply ice cubes 101 to the ice breaking part 80.

Further, according to the refrigerator of the second embodiment of the invention, when discharging the crushed ice 102, the fixed blade 46 may fully supply the rotating force of the rotating blade 42, thereby preventing the second discharging lever 53 from being opened by the rotating force of the rotating blade 42 or preventing damage to the adjacent parts.

Thus, in the refrigerator according to the invention, the plurality of the discharging levers 51 and 53 are provided adjacent to the discharging parts 31 and 33 of the ice storage part 10, respectively to control the opening and closing of the discharging parts 31 and 33, thereby selectively supplying the amount of desired ice to any one of the plurality of positions according to its use.

That is, as shown in FIGS. 4 to 6 and FIGS. 8 to 10, since it is not necessary to provide a different ice storage container 11 and ice transferring unit 20 to supply ice to the cutting part for each ice function. Therefore, the costs are reduced and a separate space is not required. Further, the configuration for distributing and supplying the ice can be simplified.

Further, according to the refrigerator of the invention, as described with regard to the shaved ice 103 discharging, when supplying the ice cubes 101 to the ice breaking part 80, the ice cubes 101 are received and rotated by the rotating blade 41 and then released into the first discharging part 31 without directly discharging the ice cubes 101 from the opening 12 to the first discharging part 31, thereby preventing ice cubes 101 within the ice storage container 11 from being excessively cause to enter into the ice breaking part 80 at once.

As described above, according to the refrigerator of the invention, it is possible to selectively distribute and supply ice stored within the ice storage part 10 to one ice transferring unit 20, according to its use, thereby reducing the costs and space necessary for the ice storage part 10.

Further, the shapes of the rotating blade and the fixed blade are improved, thereby enhancing the supporting strength when breaking the crushed ice 102 and easily supplying the ice to the ice breaking part.

Although a few exemplary embodiments of the invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator having a freezer and a freezer door for opening and closing the freezer, the refrigerator comprising:

an ice storage container provided in the freezer and formed with an opening at a side thereof;

an ice breaking part for receiving ice cubes stored in the ice storage container and making shaved ice;

a rotating blade which is rotatably provided in the opening;

a first discharging part for discharging the ice cubes discharged to the opening and crushed ice broken by the rotating blade;

a second discharging part which communicates with the ice breaking part to cause the ice cubes which are released from the opening to be transferred by the rotating blade into the ice breaking part to form the shaved ice; and first and second discharging levers for opening and closing the first discharging part and the second discharging part, respectively, wherein the second discharging lever opens the second discharging part when discharging the shaved ice.

2. The refrigerator according to claim 1 further comprising an ice transferring unit, wherein the ice transferring unit has a driving motor provided in the ice storage container, a rotating shaft having a first end connected to the driving motor and a second end extended to the opening, and a spiral blade rotatably connected to the rotating shaft and transferring the ice cubes within the ice storage container into the opening.

3. The refrigerator according to claim 2, wherein the rotating blade has a plurality of blades and the blades are plurally disposed to be spaced with respect to each other at a predetermined interval on the second end of the rotating shaft.

4. The refrigerator according to claim 3 further comprising at least one fixed blade, wherein the fixed blades are disposed at a predetermined angle with respect to each of the respective rotating blades within the rotating radii of the plurality of rotating blades to break the ice cubes transferred by the rotating blades into crushed ice.

5. The refrigerator according to claim 4, wherein the fixed blade has the shape of a long rod extending downwardly from the rotating shaft.

6. The refrigerator according to claim 5, further comprising a lever driving part for driving the discharging levers.

7. The refrigerator according to claim 6, wherein the lever driving part rotates the first discharging lever to a position for opening the first discharging part and rotates the second discharging lever to a position for closing the second discharging part.

8. The refrigerator according to claim 6, wherein the lever driving part rotates the first discharging lever and the second discharging lever to positions for opening the first discharging part and closing the second discharging part when discharging the crushed ice.

9. The refrigerator according to claim 6, wherein the lever driving part rotates the first discharging lever to a position for closing the first discharging part and rotates the second discharging lever to a position for opening the second discharging part when discharging the shaved ice.

10. The refrigerator according to claim 1, wherein the ice breaking part includes a fixing tray provided with a shaved ice discharging part, a blade provided in the shaved ice discharging part, and a rotating tray which is rotatably provided in the fixing tray to transfer the ice cubes induced into the fixing tray to the blade.

11. The refrigerator according to claim 1 further comprising a dispenser, wherein the dispenser is provided in the freezer door and an ice duct is provided in the freezer door to guide the ice discharged from the first discharging part and the second discharging part to the dispenser.

12. A refrigerator having a freezer and a freezer door for opening and closing the freezer, the refrigerator comprising:

an ice storage container provided in the freezer and formed with an opening at a side thereof;

an ice breaking part for receiving ice cubes stored in the ice storage container and making shaved ice;

a rotating blade which is rotatably provided in the opening and has three or more blades disposed at a predetermined angle therebetween for breaking the ice cubes into crushed ice;

a first discharging part for discharging the ice cubes discharged to the opening and the crushed ice broken by the rotating blade;

a second discharging part which communicates with the ice breaking part to induce the ice cubes discharged from the opening to be transferred by the rotating blade into the ice breaking part to form the shaved ice; and first and second discharging levers for opening and closing the first discharging part and the second discharging part, respectively.

13. The refrigerator according to claim 12 further comprising an ice transferring unit, wherein the ice transferring unit has a driving motor provided in the ice storage container, a rotating shaft having a first end connected to the driving motor and a second end extended to the opening, and a spiral blade rotatably connected to the rotating shaft for transferring the ice cubes within the ice storage container into the opening.

14. The refrigerator according to claim 13, wherein the rotating blade has three blades and the blades are plurally disposed to be spaced from each other at a predetermined interval on the second end of the rotating shaft.

15. The refrigerator according to claim 14 further comprising at least one fixed blade, wherein the fixed blade is disposed at a predetermined angle with respect to the respective rotating blades within the rotating radii of the plurality of rotating blades to break the ice cubes transferred by the rotating blades into crushed ice.

16. The refrigerator according to claim 15, wherein the second discharging part is provided below the opening, the first discharging part is adjacent to the second discharging part so that the ice discharged from the opening is transferred by the rotating blade and discharged to the ice breaking part, and the fixed blade having a first end connected to the rotating shaft and a second end bent in the shape of 'L'.

17. The refrigerator according to claim 15, further comprising a lever discharging part for driving the discharging levers.

18. The refrigerator according to claim 17, wherein the lever driving part rotates the first discharging lever to a position for opening the first discharging part and rotates the second discharging lever to a position for closing the second discharging part when discharging the ice cubes stored in the ice storage container.

19. The refrigerator according to claim 17, wherein the lever driving part rotates the first discharging lever and the second discharging lever to open the first discharging part and to close the second discharging part when discharging the crushed ice.

20. The refrigerator according to claim 17, wherein the lever driving part rotates the first discharging lever to a position for closing the first discharging part and rotates the second discharging lever to a position for opening the second discharging part when discharging the shaved ice.

* * * * *